US007980789B2

(12) United States Patent
Heindl

(10) Patent No.: US 7,980,789 B2
(45) Date of Patent: Jul. 19, 2011

(54) COMBINATION WALL WITH TUBE PILE CONNECTORS

(75) Inventor: Richard Heindl, Munich (DE)

(73) Assignee: Pilepro, LLC, Austin, TX (US)

( * ) Notice: Subject to any disclaimer, the term of this patent is extended or adjusted under 35 U.S.C. 154(b) by 0 days.

(21) Appl. No.: 12/380,217

(22) Filed: Feb. 25, 2009

(65) Prior Publication Data

US 2009/0214301 A1 Aug. 27, 2009

(30) Foreign Application Priority Data

Feb. 25, 2008 (DE) ..... 10 2008 010 991

(51) Int. Cl.
*E02D 5/08* (2006.01)

(52) U.S. Cl. ..... 405/278; 405/281

(58) Field of Classification Search ..... 405/272, 405/274–281
See application file for complete search history.

(56) References Cited

U.S. PATENT DOCUMENTS

| | | | | |
|---|---|---|---|---|
| 7,168,214 | B2 * | 1/2007 | Wall | 52/309.11 |
| 2005/0076595 | A1 | 4/2005 | Wall | |
| 2008/0219776 | A1 | 9/2008 | Heindl et al. | |

FOREIGN PATENT DOCUMENTS

| | | | | |
|---|---|---|---|---|
| DE | 1963243 | | | 6/1971 |
| DE | 2144689 | | | 3/1973 |
| DE | 2631807 | | | 7/1976 |
| EP | 0029273 | A1 | | 5/1981 |
| JP | 56089608 | A | * | 7/1981 |
| JP | 56119008 | A | * | 9/1981 |
| JP | 57140412 | A | * | 8/1982 |
| JP | 57151709 | A | * | 9/1982 |
| JP | 57180714 | A | * | 11/1982 |
| JP | 58110713 | A | * | 7/1983 |

* cited by examiner

*Primary Examiner* — Sunil Singh
(74) *Attorney, Agent, or Firm* — Karl F. Milde, Jr.; Eckert Seamans Cherin & Mellott, LLC

(57) ABSTRACT

A combination wall (10) for supporting the ground comprises at least two tubular piles (12) adapted to be rammed at least part way into the ground and a wall element (14) inserted between two respective adjacent tubular piles (12). The wall element (14) is provided with interlocks (22) that are used to engage the wall element (14) with interlock profiles (18) that are provided on the tubular piles (12). The wall element (14), when hung between the tubular piles (12), is designed as a segment of a circle with an at least approximately circle-segment-shaped cross-section.

13 Claims, 7 Drawing Sheets

COMBINATION WALL WITH TUBE PILE CONNECTORS

BACKGROUND OF THE INVENTION

The invention relates to a ground supporting combination wall which comprises at least two tubular piles that can be rammed at least partially into the ground and a wall element inserted between two respective adjacent tubular piles. The wall element is provided with interlocks that are used to connect to profiles that are provided at the tubular piles.

A combination wall of this type is well known in the art. Such combination walls are used, for example, in river bank areas, at coastal sections or in civil engineering projects to support the ground. In such applications, the tubular piles rammed into the ground serve as support or carrier elements, typically with sheet piles hung between them as the wall elements. In this context, tubular piles refer not only to tubular piles with a circular or oval cross-section but also to tubular piles with angular cross-sections. While the tubular piles take up the forces caused by the ground and the forces generated, for example, by ground water or surge water, the primary purpose of the sheet piles, serving as wall elements, is to seal the sections between the tubular piles. The actual holding and support forces are to a great extent taken up by the tubular piles, even though the sheet piles, such as Larssen sheet piles or Hoesch sheet piles, are also designed to take up such forces due to their Z- or U-shaped design.

Due to the dramatic increase in worldwide demand for combination walls, in particular the demand for sheet piles, and an insignificant increase in the production capacity of the existing manufacturing plants, there is a need for a solution that can, at least in part, do without the use of sheet piles.

SUMMARY OF THE INVENTION

It is, therefore, a principal objective of the present invention to provide a combination wall made of tubular piles that provides sufficient support without—at least in part—the use of sheet piles.

According to the invention, this objective is achieved by a combination wall wherein the wall element that is hung between the tubular piles is designed as a segment of a circle with an at least approximately circle-segment-shaped cross-section.

In a combination wall according to the invention, wall elements are used that are designed—in cross-sectional view—in the shape of a circle segment instead of the currently typical sheet piles. In this context, a circle-segment-shaped cross-section refers not only to cross-sectional shapes that follow an ideal circular shape with a consistent radius but also to cross-sectional shapes that deviate, at least in part, from the ideal circular shape and may have a slightly oval shape but exhibit a clear curvature.

The advantage of using circle-segment-shaped wall elements is that they fulfill the same function as the sheet piles used until now, namely to support the ground in the areas between the adjacent tubular piles and to seal these areas securely toward the outside, but they can be manufactured with less expenditure and are even available as used pipes and are, therefore, available in larger quantities. Based on the fact that the sheet piles used in combination walls thus far typically act only as sealing elements between the tubular piles, without actually increasing the stability of the combination wall under load, the circle-segment-shaped wall elements fulfill the same purpose, while the circle segment shape at the same time ensures a significantly greater inherent stiffness as compared to the flat metal sheets. Depending on the use, the curvature radius of the circle-segment-shaped wall elements is in a range of 30 to 125 cm, but may be greater in individual cases.

Additional advantageous developments of the invention are disclosed in the following description and in the drawings.

For example, for a particularly preferred embodiment of the combination wall according to the invention, it is proposed to use as the circle-segment-shaped wall element a circle segment of a tubular pile with an at least approximately circular cross-section. For this purpose, the tubular pile is separated in its longitudinal direction into individual tubular circle segments and thereafter provided with suitable interlocking profiles. However, it is also possible to shape the circle-segment-shaped wall elements from a flat semi-finished part such as a metal sheet by cold or hot forming instead of using pipe segments obtained from the tubular piles.

Preferably, the arc length of the circle-segment-shaped wall element is determined based on the forces that act upon the combination wall. If a greater distance between the sheet piles is possible, the circle-segment-shaped wall element may exhibit an arc length of up to 180°, i.e., may have a semicircular cross-sectional design. If the distance between the sheet piles is to be rather short, the arc length of the circle-segment-shaped wall elements may also be less, for example only 120°.

With one particularly preferred embodiment of the combination wall according to the invention, the outside of the circle-segment-shaped wall element that is curved outward is arranged between the tubular piles such that section of the outside of the wall element that is located furthest out, runs in one line with the sections of the two tubular piles that are located furthest out. This offers the advantage that the interlocking profiles of the tubular piles and of the wall elements are located between them and in this manner are protected from the forces that are caused by pack ice, ships, etc. and are acting upon the combination wall. However, it is also conceivable to arrange the wall element in the combination wall such that it protrudes with an arc shaped contour beyond the sections of the two tubular piles that are located furthest out and between which the wall element is hung.

Preferably, one weld-on profile each is welded as an interlock for hanging into the interlock profiles of the tubular piles to the two longitudinal edges of the circle-segment-shaped wall elements for hanging the wall element. Welding is facilitated by welding the weld-on profile to the longitudinal edges because a plane support surfaces is provided for the weld-on profiles, which facilitates, in particular, orienting and positioning of the weld-on profile during the welding procedure.

To enable pivoting of the engaging interlocks while the combination wall is erected, the interlock connection between the circle-segment-shaped wall element and the respective tubular pile is best designed such that the interlock connection allows, at least to a limited degree, pivoting of the engaging interlocks at both sides. The use of an interlock connection that is formed by a C-shaped claw and a head strip that engages in the C-shaped claw has proven to be particularly advantageous.

Preferably, the C-shaped claw is provided at the weld-on base of a weld-on profile and exhibits two claw strips that protrude mirror-symmetrically from the weld-on base, where said claw strips define an interlock jaw with their free ends and encompass an inner interlock chamber having an approximately circular or oval cross-section. The mirror-symmetrical design of the C-shaped claw ensures that the head strip that engages in the C-shaped claw can pivot in the C-shaped claw by at least approximately the same angle.

If the C-shaped claw is attached to the circle-segment-shaped wall element, it is proposed that the weld-on profile is welded with its weld-on base to one of the longitudinal edges of the wall element such that the C-shaped claw with its interlocking jaw points away from the plane side of the longitudinal edge with regard to the wall element either in the tangential or the radial direction in order to provide a defined attachment direction for the interlocking profiles. With this embodiment, it is additionally advantageous if at least one weld-on strip protrudes from the weld-on base of the weld-on profile at a right angle and is preferably welded to the inside of the circle-segment-shaped wall element. Welding of the weld-on profile is additionally simplified by the weld-on strip because both the location and the angle position of the weld-on strip are specified at the longitudinal edge of the wall element in a defined manner.

The head strip is preferably provided at the free end of a neck strip that protrudes from a weld-on base of a weld-on profile, with the thickness of the neck strip—viewed perpendicular to its longitudinal direction—being dimensioned smaller than the width of the head strip perpendicular to the longitudinal direction of the neck strip.

In order to compensate even for greater distances between two adjacent tubular piles, it is furthermore proposed to use a version of the weld-on profile for which the length of the neck strip—viewed in its longitudinal direction—corresponds to a multiple, preferably to 4 to 6 times, of the thickness of the head strip in the longitudinal direction of the neck strip. Alternatively, the neck strip may also be designed so short that only sufficient room for engaging and pivoting the C-shaped claw strip is provided.

If the weld-on profile is welded to a tubular pile, then the connection base of the weld-on profile is preferably provided with two weld-on elevations that run parallel to each other in the longitudinal direction of the profile at the rear side that faces away from the C-shaped claw strip or the head strip in order to be able to compensate for the curvature radii at the outside of the tubular pile.

Alternatively, a profile strip with a round or oval cross-section can be used instead of the connection profile that is provided with the head strip, with said profile strip being welded to the longitudinal edges of the circle-segment-shaped wall element and being engaged in the C-shaped claw of a weld-on profile that is welded to the tubular pile.

In this case, a particularly preferred embodiment of a weld-on profile for the tube element is the use of an at least approximately rectangular, preferably a square, weld-on profile in which the C-shaped claw is formed directly. In this application, two side surfaces of the weld-on profile that protrude from the base form the claw strip of the C-shaped claw, while the outsides of the side surfaces and the back side of the base that faces away from the C-shaped claw each form a weld-on surface, where the weld-on profile can be welded to the tubular pile. By providing three weld-on surfaces that are each offset from each other by 90°, it is possible to weld the weld-on profile also to the side of the tubular pile such that the jaw of the C-shaped claw does not point outward in the radial direction but extends in the tangential direction with regard to the tubular pile. To make welding of the weld-on profile even easier, preferably all weld-on surfaces of each weld-on profile are provided with two weld-on elevations that extend parallel to each other in the longitudinal direction of the weld-on profile.

Preferably, the tubular piles exhibit an at least approximately round cross-section. This has the advantage that when inserting the tubular piles and the wall elements that are to engage in them by turning the tubular piles in the ground while the tubular piles are placed, they can be oriented such that deviations in dimensions and positions of the wall element placed between the two tubular piles can be compensated in a simple manner.

When using tubular piles with an essentially circular cross-section, the curvature radius of the circle-segment-shaped wall elements corresponds at least approximately to the curvature radius of the tubular piles, which additionally facilitates the erection of the combination walls because the same piling and vibration tools can be used for the tubular piles and for the wall elements when erecting the combination wall.

Particularly preferred is the use of used pipes, in particular pipeline tubes as the tubular piles and/or as the circle-segment-shaped wall elements. Due to the extreme wear conditions caused by oil or natural gas, pipeline tubes must be replaced already after about 10 to 15 years. For example, for safety reasons, pipeline tubes typically must exhibit a minimum wall thickness of at least 20 mm, which must not be under-run. The used pipeline tubes can then be cut to suitable lengths. To produce the circle-segment-shaped wall elements, the pipeline tubes are simply separated into individual segments in the longitudinal direction. Due to the high number of available used pipes, in particular pipeline tubes, the problem of the current high demand can be solved in a simple and elegant manner.

The combination wall according to the invention can also be combined with other combination wall types such as wall types made of I-beams and sheet piles or tubular piles and sheet piles, if this appears desirable.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
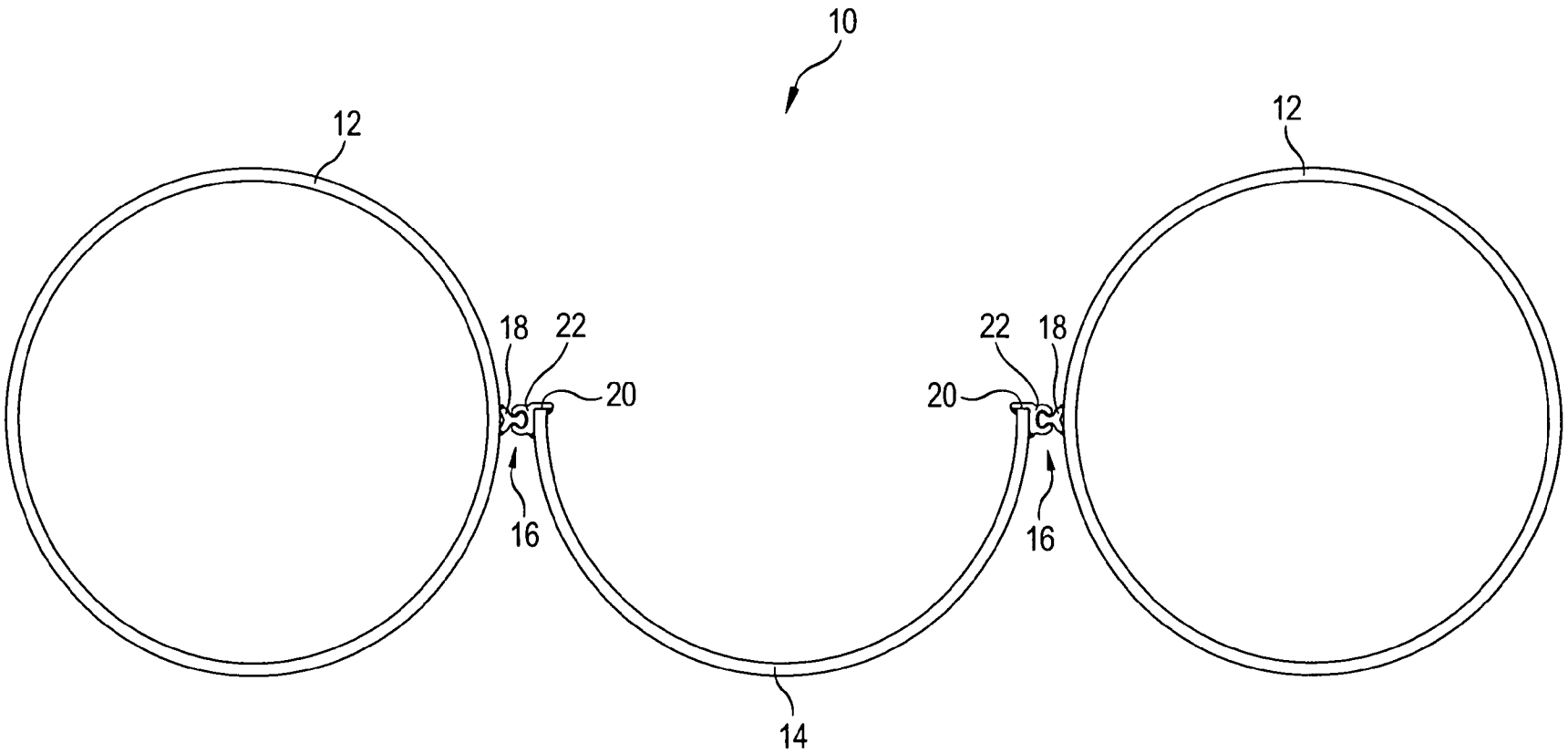
FIG. 1 is a top view of a first preferred embodiment of a combination wall according to the invention with two tubular piles and a circle-segment-shaped wall element with an arc length of 180° hung between said tubular piles.

The preferred embodiments of the present invention will now be described with reference to FIGS. 1-7 of the drawings. Identical elements in the various figures are designated with the same reference numerals.

FIG. 1 shows a top view of a section of a first preferred embodiment of a combination wall 10 according to the invention. The combination wall 10 exhibits two tubular piles 12 that have been rammed into the ground in a conventional manner. In the embodiment shown, two used pipeline tubes shortened to the desired length are used as the tubular piles 12.

A circle-segment-shaped wall element 14 with an arc length of 180°, i.e., with a semi-circular shape, is arranged between the tubular piles 12. The wall element 14 has also been made from a used pipeline tube that has been shortened to the desired length and cut in half in the longitudinal direction. The wall element 14 is connected to the two tubular piles 12 by the two interlock connections 16.

The two interlock connections 16 are designed identically and each exhibit a first weld-on profile 18 welded to the tubular pile 12 and a second weld-on profile 22 welded to each longitudinal edge 20 of the wall element 14. Below, the interlock connection 16 is explained in greater detail with reference to FIG. 2, where the interlock connection 16 is shown magnified, viewed perpendicular to the longitudinal direction.

Figure 2:
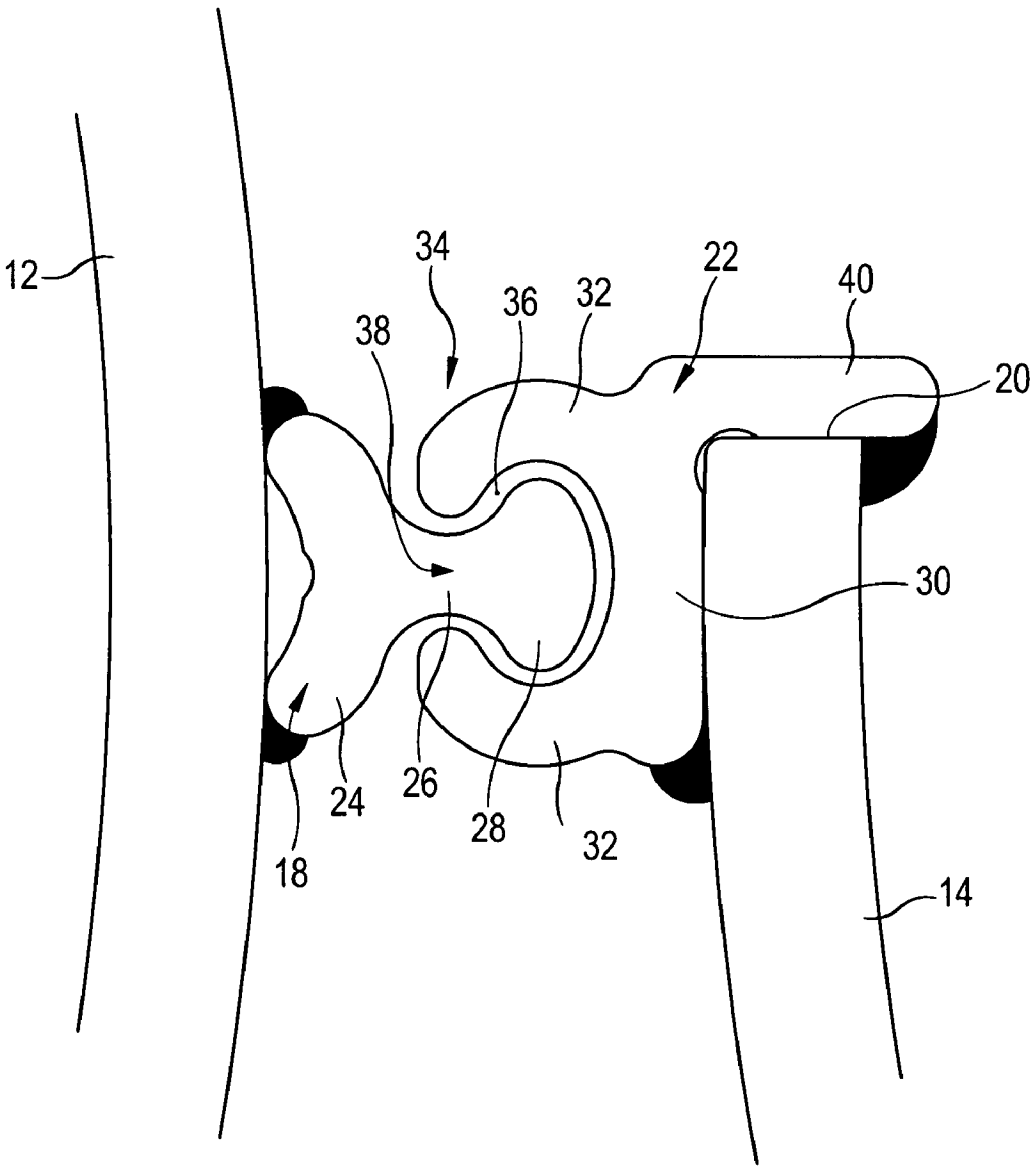
FIG. 2 is a magnified top view of the interlock connection between the wall element and the tubular pile shown in FIG. 1.

The first weld-on profile 18 exhibits a slightly bent weld-on base 24, from which a neck strip 26 protrudes. Formed onto the free end of the neck strip 26 is a head strip 28 with an at least approximately oval head strip 28 that is greater in its width, viewed perpendicular to the longitudinal direction of the neck strip 26, than in its length, such that its main axis of the oval of the head strip 28 runs perpendicular to the longitudinal direction of the neck strip 26. The width of the head strip 28 corresponds approximately to twice the thickness of the neck strip 26 perpendicular to the longitudinal direction of the neck strip 26. The thickness of the head strip 28 in the longitudinal direction of the neck strip 26 corresponds approximately to the length of the neck strip as shown in FIG. 2. The first weld-on profile 18 is welded in the longitudinal direction of the tubular pile 12 to its surface of the outer circumference with the weld-on base 24, with the curved contour of the weld-on base 24 facilitating the welding procedure.

The second weld-on profile 22 exhibits a weld-on base 30 that extends flatly and from which two claw strips 32 protrude mirror-symmetrically. The claw strips 32 that form a C-shaped claw 34 encompass an at least approximately oval inside interlock chamber 36 and define an interlock jaw 38 with their free ends. The neck strip 26 of the first weld-on profile 18 reaches through the interlock jaw 38 with the head strip 28 being received in the interlock chamber 36.

A weld-on strip 40 protrudes at least approximately at a right angle at the one longitudinal side of the rear side of the weld-on base 30 of the second weld-on profile 22. The second weld-on profile 22 rests with its weld-on strip 40 on the longitudinal edge 20 of the wall element 14 and with its free end is welded to the transition of the longitudinal edge 20 on the inside of the wall element 14, while the second weld-on profile 22 with the plane rear side of its weld-on base 30 is supported at the curved outer surface of the wall element 14 and is welded to it on the side.

As can be seen in FIG. 1, the two first weld-on profiles 18 are welded to the two tubular piles 12 and the tubular piles 12 are rammed into the ground such that the wall element 14 that is inserted between the tubular piles 12 runs with its section of the surface that is curved outward and is located furthest out at least approximately in one line with the sections of the tubular piles 12 that are located furthest out. In this manner, the interlock connections 16 that are used allow to some limited extent pivoting of the tubular piles 12 in relation to the wall element 14 in order to set the desired position of the wall element 14 during the erection of the combination wall 10.

Figure 3:
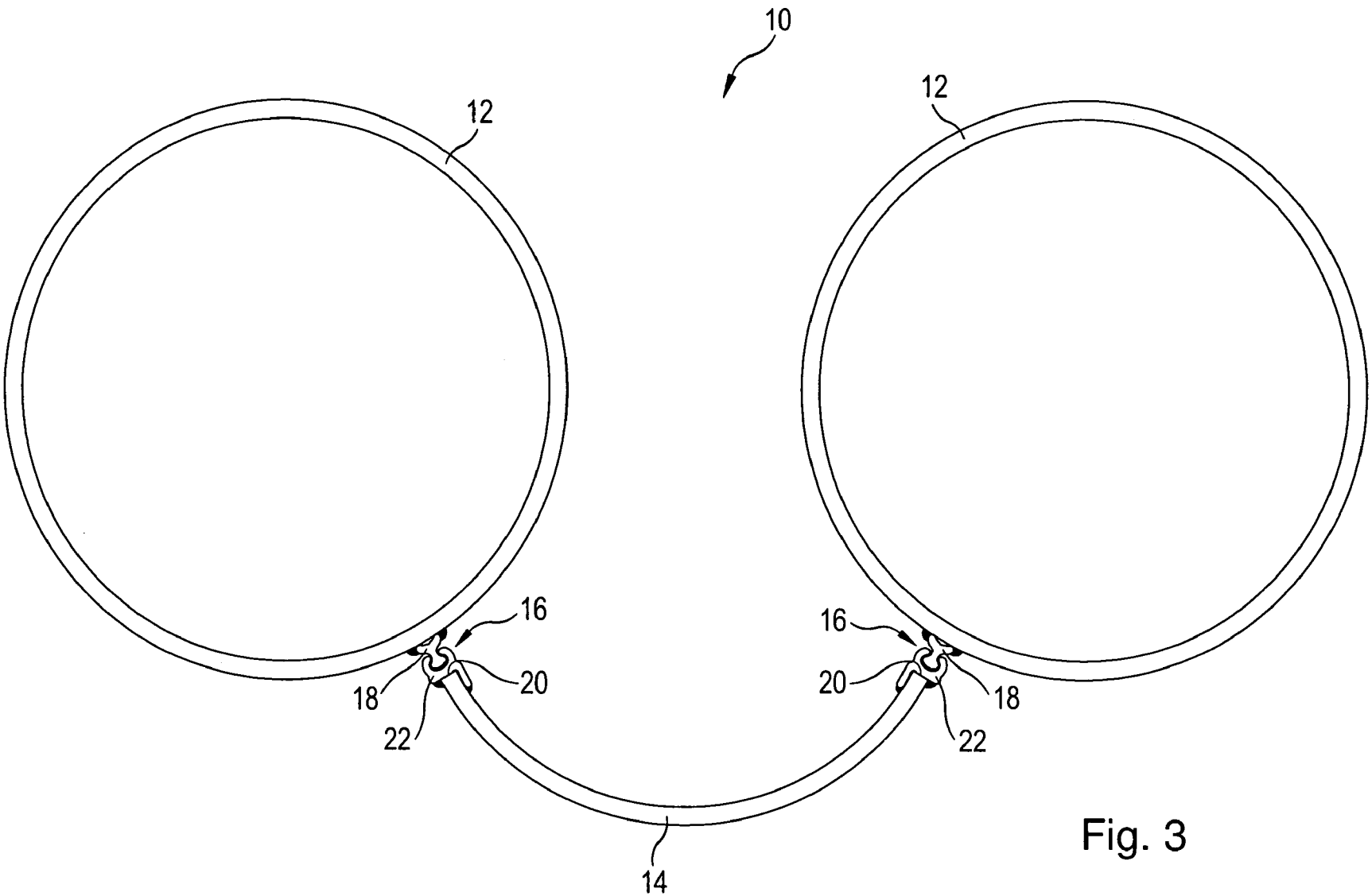
FIG. 3 is a top view of a first variation of the first preferred embodiment where the circle-segment-shaped wall element has an arc length of 120°.

FIG. 3 shows a first variation of the connection element 10 shown in FIG. 1. In this variation, the wall element 14 is designed as a ⅓ segment of a circle, i.e., it has an arc length of 120°. Furthermore, with this variation, the two second connection profiles 22 are welded to the longitudinal edges 20 of the wall element 14 such that the two connection profiles 22 rest with the rear sides of their weld-on bases 30 at the longitudinal edges 20 of the wall element 14, while the weld-on strip 40 stretches inward, rests on the inside surface of the wall element 14 that is curved inward and is welded to it. In this manner, the two C-shaped claws 34 point away from the longitudinal edges 20 of the wall element 14 in the tangential direction.

The two first connection profiles 18 are welded to the tubular piles 12 as shown for the combination wall 10 shown in FIG. 1. However, the tubular piles 12 are rotated such that the wall element 14 with the connection profiles 22 welded to it in this manner is hung such that the wall element 14 protrudes beyond the tubular piles 12 arranged in a common line.

Figure 4:
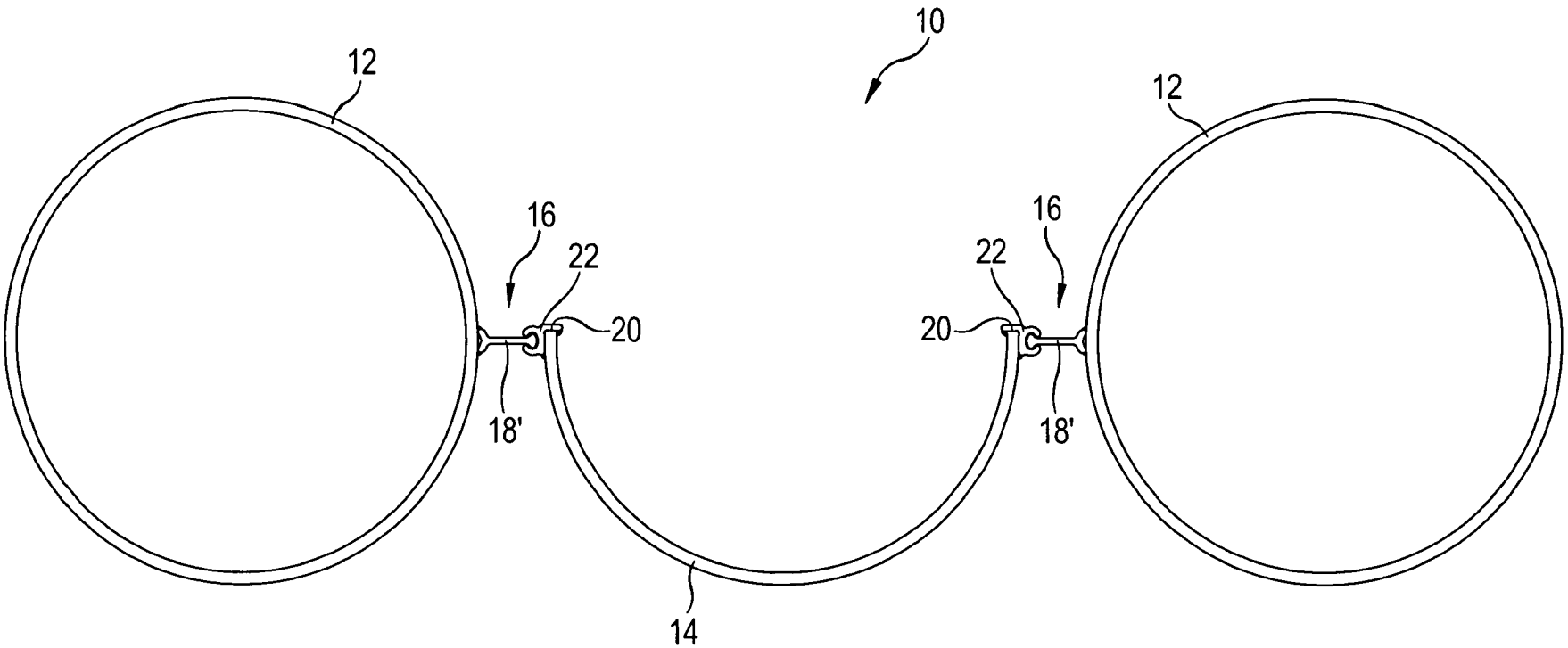
FIG. 4 is a top view of a second variation of the first preferred embodiment where the two tubular piles are equipped with weld-on profiles with extended neck strips.

FIG. 4 shows a top view of a second variation of the combination wall shown in FIG. 1. With this second variation, slightly modified first connection profiles 18', which differ from the connection profiles 18 shown in FIG. 1 only in that the length of the neck strip corresponds at least approximately to 6 times the thickness of the head strip viewed in the longitudinal direction of the neck strip, are welded to the tubular piles. As a result of the elongated neck strip, the distance between the tubular piles 12 can be designed larger when compared to the combination wall 10 shown in FIG. 1. By using the modified first connection profiles 18' shown in FIG. 4, slight deviations in the position between the tubular piles 12 can be compensated, for example. It is furthermore conceivable to combine the one tubular pile 12 with its first connection profile 18 and the adjacent tubular pile 12 with its modified connection profile 18'. The first variation shown in FIG. 2 can also be equipped with the connection profile 18' shown in FIG. 4.

Figure 5:
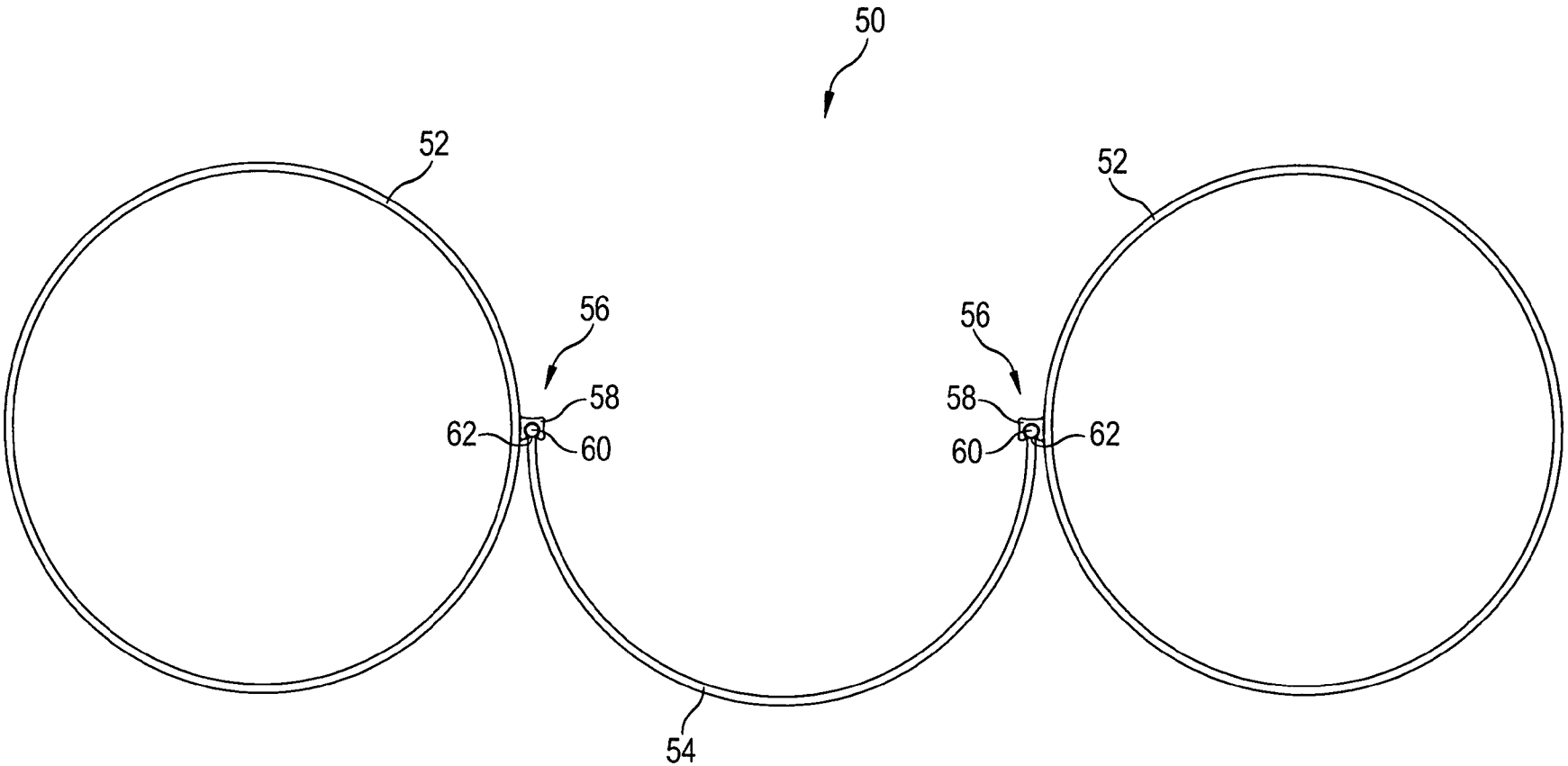
FIG. 5 is a top view of a second preferred embodiment of a combination wall according to the invention, where at every longitudinal edge of the 180° arc-length circle-segment-shaped wall element a profile strip with a round cross-section is welded on that engages with a C-shaped claw that is formed into the weld-on profile with a square cross-section.

FIG. 5 shows a top view of a second preferred embodiment of a combination wall 50. The combination wall 50 is also made of tubular piles 52 and wall elements 54 with one wall element 54 each being hung between two adjacent tubular piles 52. With the second exemplary embodiment, the wall element 54 is connected to the tubular piles through two interlock connections 56; their design will be explained in greater detail with reference to FIG. 6.

The interlock connections 56 are designed identical as well and exhibit each a first weld-on profile 58 that is welded to the outer wall of the respective tubular pile 52 in the longitudinal direction, and a profile strip 60 with a round cross-section serving as an interlock that is welded to the longitudinal edge 62 of the wall element 54.

The first weld-on profile 58 exhibits an at least approximately square base body in a cross-sectional view with two side surfaces 66 that protrude from a base 64 and form at the same time the claw strip for a claw 68 with a C-shaped cross-section. The outer sides of the side surfaces 66 as well as the rear side of the base 64 that faces away from the C-shaped claw 68 serve as weld-on surfaces and are each provided with two weld-on elevations 70 that run parallel to each other in the longitudinal direction of the weld-on profile 58.

Figure 6:
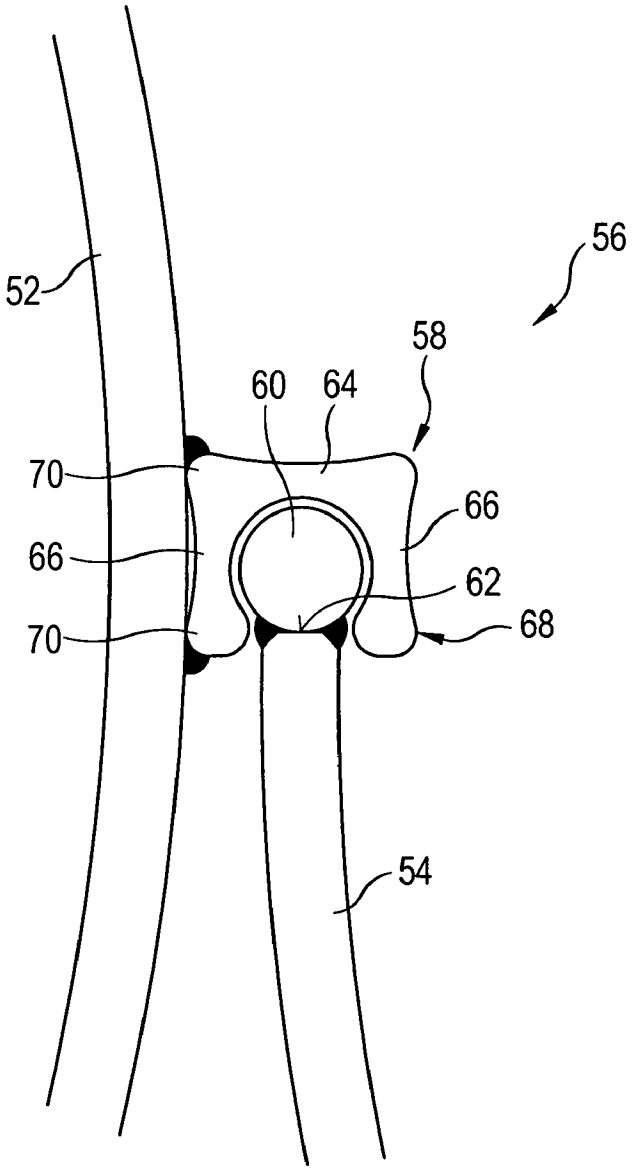
FIG. 6 is a magnified top view of the interlock connection between the wall element and the tubular pile shown in FIG. 5.

As the top views shown in FIGS. 5 and 6 show, the two weld-on profiles 58 are each welded with the weld-on elevations 70 of their side surfaces 66 to the lateral surface area of the respective tubular pile 52 such that the C-shaped claw 68 points in a direction that runs tangential to the lateral surface area of the tubular pile 52. With its profile strip 60 that exhibits a round cross-section, the wall element 54 engages in the C-shaped claw 68 and is in this manner connected to the tubular pile 53 in a movable and secure manner.

Figure 7:
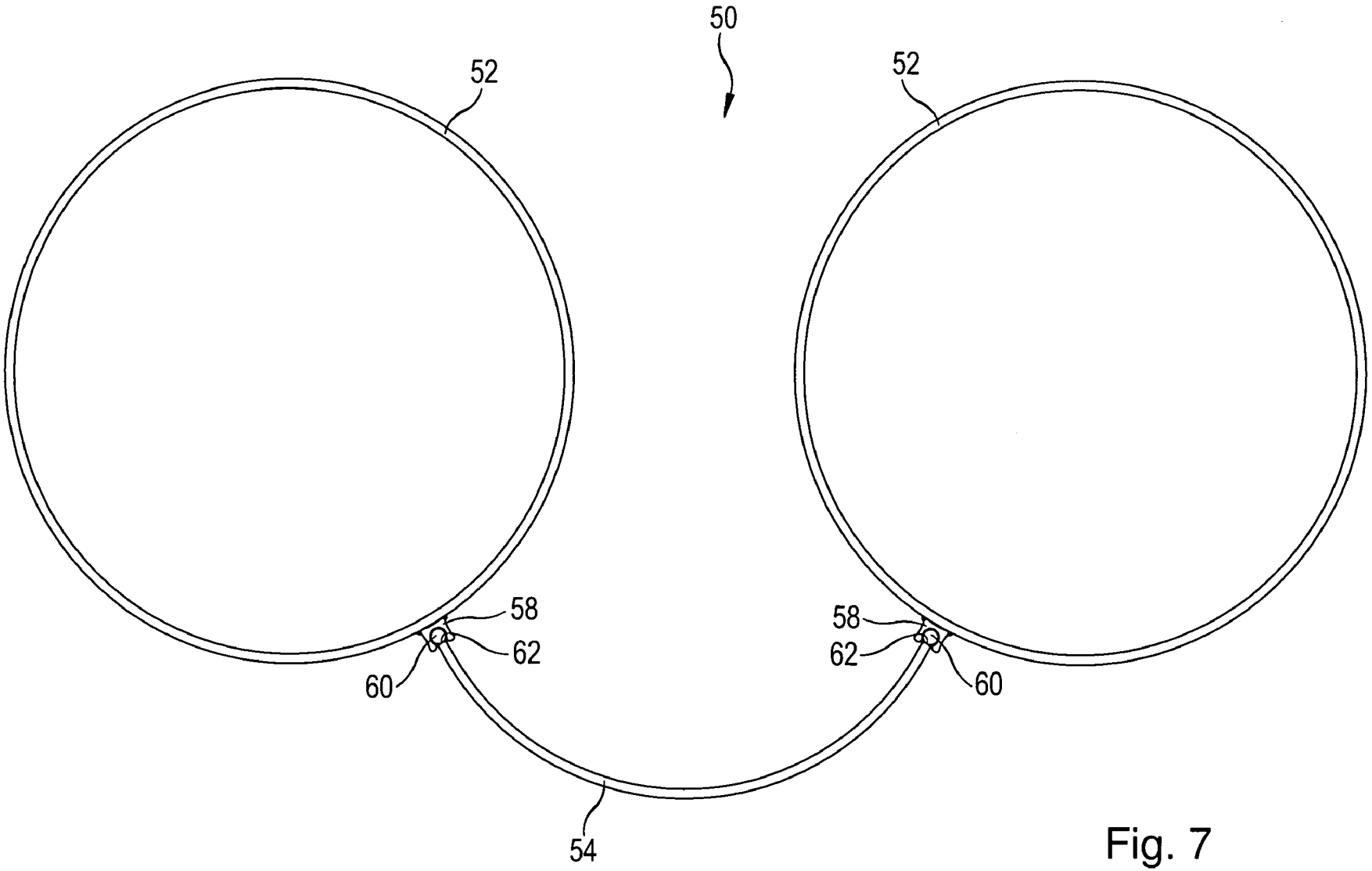
FIG. 7 is a top view of a variation of the preferred embodiment shown in FIG. 5, where the circle-segment-shaped wall element exhibits an arc length of 120° and the weld-on profile is welded to the tubular pile rotated by 90°.

FIG. 7 shows a variation of the combination wall 50 shown in FIGS. 5 and 6, which differs from the combination wall 50 only in that the wall element 54 exhibits an arc length of only 120° and in that the first connection profiles 58 are each welded with the weld-on elevations 70 on the rear side of the base 64 to the lateral surface area of the tubular piles 52.

The use of the wall elements 14 and 54 with an arc length of 180° as shown in FIGS. 1 and 5 results in an arrangement of the interlock connections 16 or 56, respectively, where the weld seams of the engaging interlocks need to take up only forces that are perpendicular to the weld seams. At the same time, a protected arrangement of the wall element 14 or 54 is created between the tubular piles 12 or 52, respectively.

With the variations shown in FIGS. 3 and 7, the weld seams of the interlock connections 16 or 56 are only stressed by pressure forces such that a malfunction of the weld seams can be virtually excluded even after the combination wall 10 or 50 has been in the ground and/or in water for a long time.

By using thick-walled tubes for the tubular piles 12 and 52 as well as for the wall elements 14 and 54 with corresponding massive designs of the interlock connections 16 and 56, the expenditures for corrosion protection can be minimized. This results in additional savings, in particular for steel work, coating and handling, thus creating an above average advantage with regard to costs and logistics.

There has thus been shown and described a novel combination wall with tube pile connectors which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A combination wall for supporting the ground comprising at least two tubular piles adapted to be rammed into the ground and a wall element inserted between two respective adjacent tubular piles, said tubular piles being provided with first interlock profiles that are used to hang the wall element by interlocking second interlock profiles that are provided on the wall element, said first and second interlock profiles defining an interlock connection when engaged, wherein the wall element that is hung between the tubular piles is formed as a segment of a circle with an at least approximately circle-segment-shaped cross-section having a maximum arc length of approximately 180° ; and wherein the interlock connection between the circle-segment-shaped wall element and each respective tubular pile comprises (1) the second interlock profile with a claw having a C-shaped cross-section, the C-shaped claw being formed by two mirror-symmetrical claw strips that protrude from a weld-on base with the free ends thereof defining an interlock jaw and enclosing an inner interlock chamber with an at least approximately circular or oval cross-section, and (2) the first interlock profile with a head strip that engages with the C-shaped claw, the first interlock profile having the head strip formed at the free end of a neck strip which protrudes from a weld-on base, wherein the thickness of the neck strip, viewed perpendicular to its longitudinal direction, is dimensioned smaller than the width of the head strip perpendicular to the longitudinal direction of the neck strip; wherein the weld-on base of the second interlock profile provided with the C-shaped claw is welded to the circle-segment-shaped wall element adjacent a flat side of a longitudinal edge thereof, such that the C-shaped claw with its interlock jaw points away from the flat side of the longitudinal edge in one of (a) a tangential and (b) a radial direction, respectively, of the circle-segment-shaped wall element; and wherein a weld-on strip protrudes from the weld-on base of the second interlock profile.

2. A combination wall as defined in claim 1, wherein the wall element that is hung between the tubular piles is a tube circle segment with an at least approximately round cross-section.

3. A combination wall as defined in claim 1, wherein the outside of the outward curved circle-segment-shaped wall element is arranged between the tubular piles such that the section of the outside of the wall element that is located furthest out runs in a common line with the sections of the two tubular piles that are located furthest out.

4. A combination wall as defined in claim 1, wherein the weld-on strip that protrudes from the weld-on base of the weld-on profile is welded to a lateral surface of the circle-segment-shaped wall element or to a longitudinal edge thereof itself when the C-shaped claw points in the tangential or radial direction, respectively.

5. A combination wall as defined in claim 4, wherein the weld-on strip is a substantially straight strip that protrudes at a right angle from the weld-on base of the second interlock profile.

6. A combination wall as defined in claim 1, wherein the length of the neck strip viewed in its longitudinal direction corresponds to a multiple of the thickness of the head strip when viewed in the longitudinal direction of the neck strip.

7. A combination wall as defined in claim 6, wherein the multiple is in the range of 4 to 6.

8. A combination wall as defined in claim 6, wherein the multiple is 1.

9. A combination wall as defined in claim 1, wherein the tubular piles exhibit an at least approximately round cross-section.

10. A combination wall as defined in claim 9, wherein the curvature radius of the circle-segment-shaped wall elements corresponds at least approximately to the curvature radius of the tubular piles.

11. A combination wall as defined in claim 1, wherein at least a portion of the tubular piles is produced from used pipeline tubes.

12. A combination wall as defined in claim 1, wherein at least a portion of the circle-segment-shaped wall elements is produced from used pipeline tubes.

13. A combination wall as defined in claim 1, wherein the weld-on strip is arranged on the inside surface of the circle-segment-shaped wall element.

* * * * *